US007207273B2

(12) United States Patent
Brunn

(10) Patent No.: US 7,207,273 B2
(45) Date of Patent: Apr. 24, 2007

(54) BUCKSHOT ROUND

(76) Inventor: Michael Brunn, 14 Winding Way, Sea Cliff, NY (US) 11579

( * ) Notice: Subject to any disclaimer, the term of this patent is extended or adjusted under 35 U.S.C. 154(b) by 0 days.

(21) Appl. No.: 11/110,232

(22) Filed: Apr. 20, 2005

(65) Prior Publication Data

US 2006/0236888 A1 Oct. 26, 2006

(51) Int. Cl.
*F42B 7/04* (2006.01)
*F42B 7/06* (2006.01)

(52) U.S. Cl. ..... 102/450; 102/446; 102/457; 102/461; 42/77; 89/29

(58) Field of Classification Search ..... 102/446, 102/444, 449, 448, 450, 451, 457, 529, 447, 102/445, 452, 453, 461, 462, 463, 464, 465, 102/466; 42/77, 76.01; 89/29, 14.05, 16
See application file for complete search history.

(56) References Cited

U.S. PATENT DOCUMENTS 3,618,250 A * 11/1971 Grandy ..... 42/77
4,126,954 A * 11/1978 Plummer ..... 42/77
5,157,210 A * 10/1992 Davis ..... 42/77
5,363,769 A * 11/1994 Bellak et al. ..... 102/446
6,446,559 B1 * 9/2002 Vallender et al. ..... 102/446
6,606,952 B2 * 8/2003 Vallender et al. ..... 102/446
2006/0260500 A1 * 11/2006 Engel et al. ..... 102/448

FOREIGN PATENT DOCUMENTS

SE 9803343 A * 4/2000

OTHER PUBLICATIONS

English translation of SE 9803343 A.*

* cited by examiner

*Primary Examiner*—James S. Bergin
(74) *Attorney, Agent, or Firm*—Townsend & Banta

(57) ABSTRACT

A buckshot round for use in large, smooth-barreled weapons, such as an M203 or M79 grenade launcher, wherein the round itself acts as the firing barrel. In particular, a lethal buckshot round is provided, wherein an inner metal cylinder (barrel portion) is encased in an outer jacket, and a shot wad is contained in the inner metal cylinder, such that the inner metal cylinder acts as a barrel for firing of the buckshot from the smooth-barreled weapon. The barrel portion of the buckshot round acts as the firing barrel, and prevents contact of the buckshot with the weapon barrel during firing, thereby providing an accurate firing pattern and preventing damage to the weapon barrel.

14 Claims, 3 Drawing Sheets

BUCKSHOT ROUND

FIELD OF THE INVENTION

The present invention provides a buckshot cartridge for deployment of lethal ordnance using a large, rifled-barreled weapon, such as an M203 or M79 grenade launcher. In particular, a lethal buckshot round is provided, wherein an inner metal cylinder is encased in an outer composite jacket, and a shot wad is contained in the inner metal cylinder, such that the inner metal cylinder acts as a barrel for firing of the buckshot from a large, rifled- or smooth-barreled weapon.

BACKGROUND OF THE INVENTION

Traditionally, soldiers have been equipped with various small arms, including larger rifled-barreled weapons, such as the M203 or M79 grenade launcher. Such grenade launchers are designed to fire grenades, such as the M430 HEDP (high explosive dual purpose). However, military organizations have desired to use these weapons to fire other ordnance in other applications, such as shotgun rounds for close quarter combat and forced entry applications.

Thus, a so-called M576 round was provided, which allows firing of lead shot from the M203 or M79 grenade launchers. The M576 cartridge, however, propels the shot at a relatively low velocity, thus limiting its effectiveness.

Therefore, it is an object of the present invention to provide a buckshot round for firing from a rifled-barreled weapon, such as the M203 or M79 grenade launcher, having a higher velocity and accuracy.

SUMMARY OF THE INVENTION

In order to achieve the object of the invention described above, in a first embodiment of the present invention, a buckshot round is provided comprising:

(a) a barrel portion having:

i. a base, said base having a primer aperture disposed therethrough;

ii. a barrel portion outer circumference;

iii. a barrel portion inner circumference opposite said outer circumference, said inner circumference defining a barrel interior portion;

iv. an end opposite said base; and v. a barrel length defined by a distance of the barrel from the base to the end;

(b) an outer jacket having:

i. a base;

ii. an outer circumference; and iii. an inner circumference, said outer jacket disposed adjacent said barrel portion such that the outer jacket inner circumference is adjacent the barrel portion outer circumference;

(c) a primer disposed within said primer aperture;

(d) propellant disposed within the interior portion of the barrel portion adjacent said base and said primer;

(e) a shot wad disposed within the interior portion of the barrel portion adjacent the propellant; and (f) a wad disposed within the interior portion of the barrel portion adjacent the shot wad.

In a second embodiment of the present invention, the buckshot round of the first embodiment is provided, wherein the outer jacket is a composite material.

In a third embodiment of the present invention, the buckshot round of the second embodiment is provided, wherein the outer jacket is formed around the barrel portion, so as to be integral therewith.

In a fourth embodiment of the present invention, the buckshot round of the third embodiment is provided, wherein the outer circumference of the barrel portion comprises a groove formed therein, so as to prevent movement of the outer jacket relative to the barrel portion after the outer jacket is formed around the barrel portion.

In a fifth embodiment of the present invention, the buckshot round of the second embodiment is provided, wherein the outer jacket is a thermoplastic.

In a sixth embodiment of the present invention, the buckshot round of the second embodiment is provided, wherein the outer jacket is nylon.

In a seventh embodiment of the present invention, the buckshot round of the first embodiment is provided, wherein the barrel portion is formed of a metallic material.

In an eighth embodiment of the present invention, the buckshot round of the first embodiment above is provided, wherein the wad is disposed in the barrel interior portion at a distance of about $1/4^{th}$ to $1/3^{rd}$ the barrel length from the end of the barrel.

In a ninth embodiment of the present invention, the buckshot round of the first embodiment above is provided, wherein the wad is disposed in the barrel interior portion at a distance of about $1/3^{rd}$ the barrel length from the end of the barrel.

DETAILED DESCRIPTION OF THE INVENTION

Figure 1:
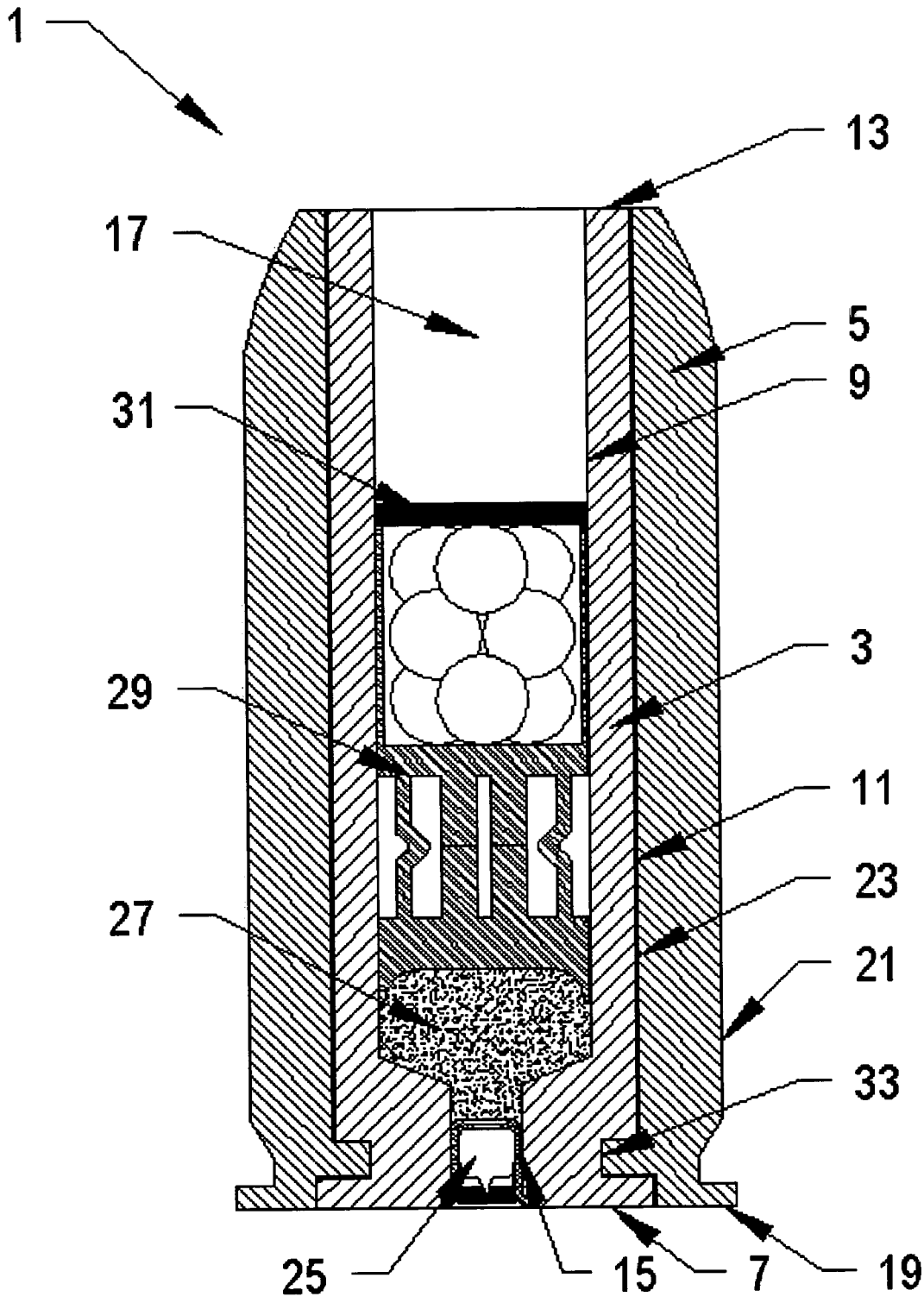
FIG. 1 is a cross sectional view of the buckshot round of the first through fourth embodiments of the present invention.
Figure 2:
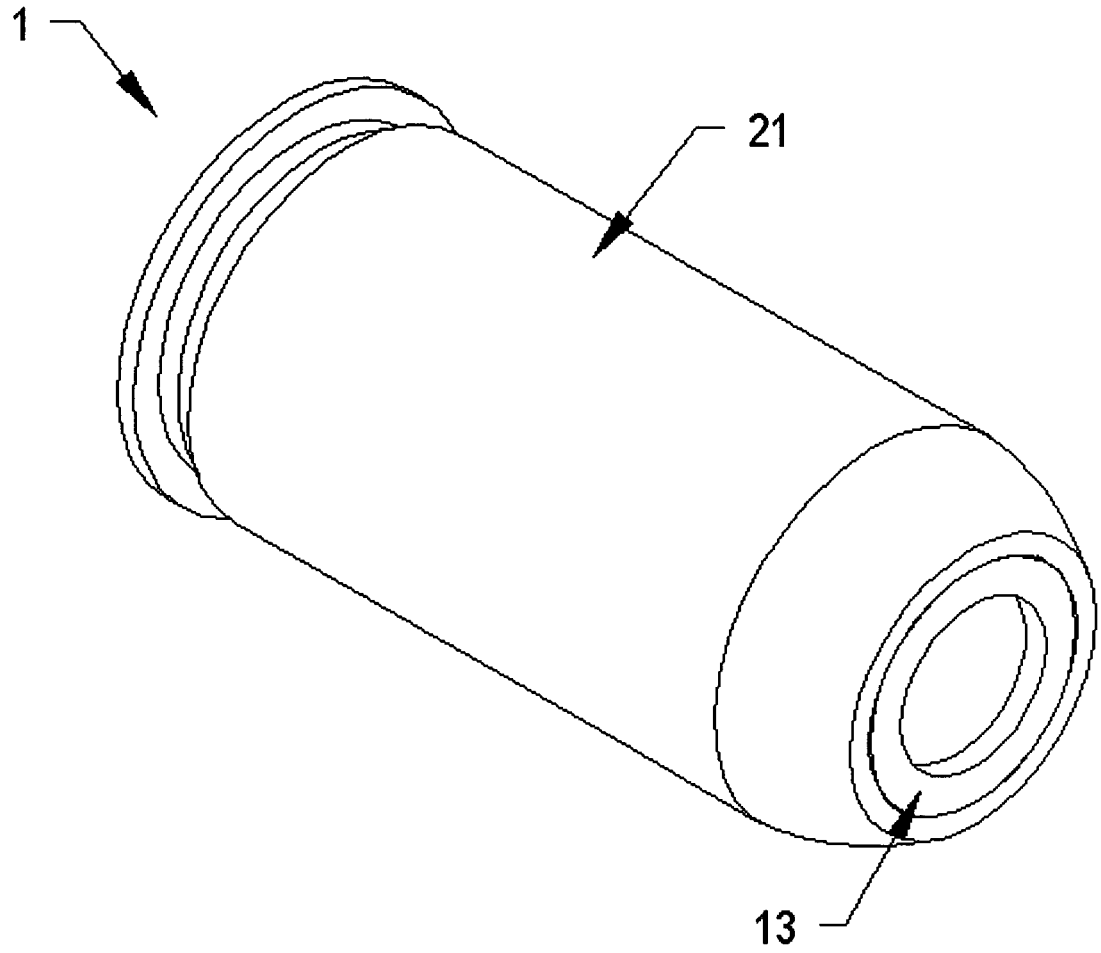
FIG. 2 is a perspective view of the buckshot round of the present invention shown in FIG. 1.
Figure 3:
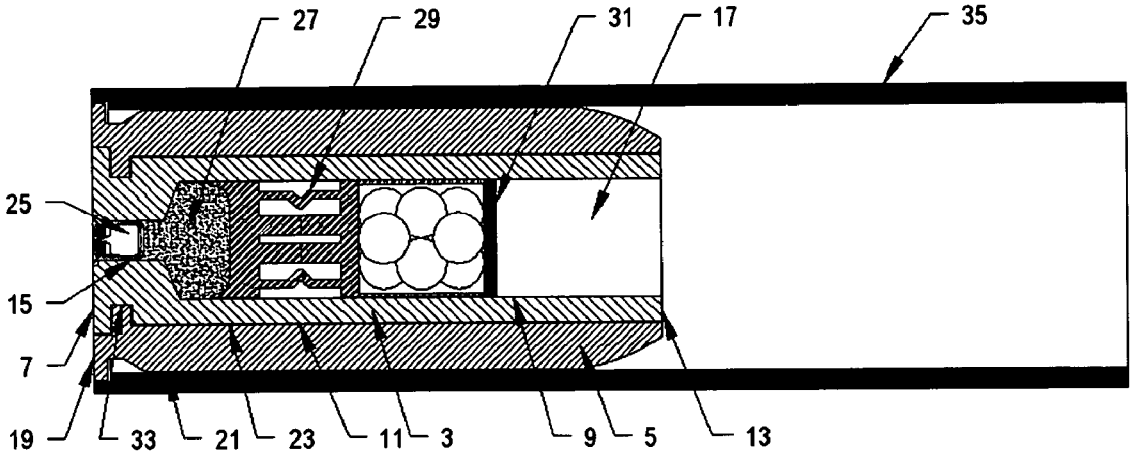
FIG. 3 is a partial cross sectional view illustrating the buckshot round of the present invention disposed in the barrel of an M203 grenade launcher before firing.

As illustrated in FIGS. 1 and 2, the buckshot round 1 of the present invention is comprised, generally, of a barrel portion 3, and an outer jacket 5 encasing the barrel portion 3, which contains shot. The barrel portion 3 is, in particular, comprised of a base 7, a barrel portion inner circumference 9, a barrel portion outer circumference 11, and an end 13.

The base 7 has a primer aperture 15 disposed therethrough, so as to allow for the disposition therein of a primer. The barrel portion outer circumference 11, and the barrel portion inner circumference 9 are disposed between the base 7 and end 13, and opposite one another, with said inner circumference 9 defining a barrel interior portion 17.

The outer jacket 5 is comprised of a base 19, an outer circumference 21, and an inner circumference 23. The inner circumference 23 of the outer jacket 5 is disposed adjacent said barrel portion 3 such that the outer jacket inner circumference is adjacent to and in contact with the barrel portion outer circumference 11. A primer 25 is disposed within said primer aperture 15.

Further, as illustrated in FIG. 1, a propellant material 27 is disposed within the barrel interior portion 17 of the barrel portion 3 adjacent the base 7 and the primer 25. A shot wad 29, which contains shot (buckshot) is disposed within the barrel interior portion 17 of the barrel portion 3 adjacent the propellant material 27. A wad 31 is disposed within the barrel interior portion 17 of the barrel portion 3 adjacent the shot wad 29, so as to secure the shot wad within the barrel interior portion 17 before firing thereof.

As called for in the second embodiment herein, the outer jacket 5 is formed, preferably, of a composite material. For example, as called for in the third emdbodiment herein, the outer jacket 5 may be formed of a thermoplastic material capable of being molded around the barrel portion 3 during production of the buckshot round 1. By such a molding procedure, the outer jacket 5 may be securely fixed to the barrel portion 3, and may be formed with varying outer jacket outer circumferences 21. This way, the buckshot round 1 may be manufactured for various weapons having differing barrel diameters, while using the same barrel portion 3 in all rounds, resulting in a savings in manufacturing costs.

It was found that the outer jacket 5 tends to slide relative to the barrel portion 3 after molding therearound. However, as called for in the fourth embodiment herein, the present inventor unexpectedly discovered that forming a groove 33 in the outer circumference 11 of the barrel portion 3 prevents movement of the outer jacket 5 relative to the barrel portion 3. In particular, during the molding process, the composite material of which the outer jacket 5 is formed flows into the groove 33, and acts to lock the outer jacket 5 in place relative to the barrel portion 3.

The barrel portion 3 is formed, generally, of a metallic material. Preferably, the barrel portion is formed of steel having a hardness sufficient to contain and direct the firing of the shot, while having the minimum thickness possible to achieve same so as to provide the lightest possible round. Alternatively, the barrel portion may be formed of a composite material having a hardness sufficient to properly fire the shot.

As called for in the eighth embodiment of the present invention herein, the wad 31 is disposed in the barrel interior portion 17 at least $\frac{1}{4}^{th}$ to $\frac{1}{3}^{rd}$ of the total barrel length from the end 13 of the barrel portion. This placement of the wad 31 in the barrel interior portion 17 allows for the barrel portion inner circumference 9 located between the wad 31 and the barrel portion end 13 to act as the firing barrel for firing of the shot wad (containing buckshot. In a preferred embodiment of the present invention, as called for in the ninth embodiment herein, the wad 31 is disposed in the barrel interior portion 17 at about $\frac{1}{3}^{rd}$ of the total barrel length from the end 13 of the barrel portion. This disposition of the wad allows an optimum length of firing barrel for the shot wad.

Importantly, a minimum distance must be maintained between the wad 31 and the barrel portion end 13, so as to provide a sufficient barrel length for firing of the shot wad 29 from the buckshot round 1. By doing so, the fired shot produces a very consistent firing pattern when fired, and does not come into contact with the weapon barrel itself.

The buckshot round 1 of the present invention may be used in a rifled-barreled weapon, such as the M203 or M79 grenade launcher as mentioned above. However, the applicability of the round 1 should not be limited to such, as the round 1 may also be used in smooth-barreled weapons where, for example, it is desirable that the shot not come into contact with the weapon barrel itself.

FIGURE ELEMENT NUMBERING LIST

1 buckshot round
3 barrel portion
5 outer jacket
7 barrel portion base
9 barrel portion inner circumference
11 barrel portion outer circumference
13 barrel portion end
15 primer aperture
17 barrel interior portion
19 outer jacket base
21 outer jacket outer circumference
23 outer jacket inner circumference
25 primer
27 propellant material
29 shot wad
31 wad
33 barrel portion outer circumference groove
35 weapon barrel

What is claimed is:

1. A buckshot round comprising:

(a) a barrel portion having:
- i. a base, said base having a primer aperture disposed therethrough;
- ii. a barrel portion outer circumference;
- iii. a barrel portion inner circumference opposite said outer circumference, said inner circumference defining a barrel interior portion; and
- iv. an end opposite said base,
- v. a barrel length defined by a distance of the barrel from the base to the end;

(b) an outer jacket formed of a composite material and having:
- i. a base;
- ii. an outer circumference; and
- iii. an inner circumference, said outer jacket formed around the barrel portion so as to be integral therewith and disposed adjacent said barrel portion such that the outer jacket inner circumference is adjacent the barrel portion outer circumference, the outer circumference of the barrel portion comprises a groove formed therein, so as to prevent movement of the outer jacket relative to the barrel portion after the outer jacket is formed around the barrel portion;

(c) a primer disposed within said primer aperture;

(d) propellant disposed within the interior portion of the barrel portion adjacent said base and said primer;

(e) a shot wad disposed within the interior portion of the barrel portion adjacent the propellant; and (f) a wad disposed within the interior portion of the barrel portion adjacent the shot wad.

2. The buckshot round of claim 1, wherein the outer jacket is a thermoplastic.

3. The buckshot round of claim 1, wherein the outer jacket is nylon.

4. A buckshot round of comprising:

(a) a barrel portion having:
- i. a base, said base having a primer aperture disposed therethrough;
- ii. a barrel portion outer circumference;
- iii. a barrel portion inner circumference opposite said outer circumference, said inner circumference defining a barrel interior portion; and
- iv. an end opposite said base, and
- v. a barrel length defined by a distance of the barrel from the base to the end;

(b) an outer jacket having:
- i. a base;
- ii. an outer circumference; and
- iii. an inner circumference, said outer jacket disposed adjacent said barrel portion such that the outer jacket inner circumference is adjacent the barrel portion outer circumference;

(c) a primer disposed within said primer aperture;

(d) propellant disposed within the interior portion of the barrel portion adjacent said base and said primer;

(e) a shot wad disposed within the interior portion of the barrel portion adjacent the propellant; and (f) a wad disposed within the interior portion of the barrel portion adjacent the shot wad, said wad being disposed in the barrel interior portion at a distance of about $1/4^{th}$ to $1/3^{rd}$ the barrel length from the end of the barrel.

5. The buckshot round of claim 4, wherein the outer jacket is a composite material.

6. The buckshot round of claim 4, wherein the outer jacket is formed around the barrel portion so as to be integral therewith.

7. The buckshot round of claim 4, wherein the outer circumference of the barrel portion comprises a groove formed therein, so as to prevent movement of the outer jacket relative to the barrel portion after the outer jacket is formed around the barrel portion.

8. The buckshot round of claim 4, wherein the barrel portion is formed of a metallic material.

9. A buckshot round comprising:

(a) a barrel portion having:

i. a base, said base having a primer aperture disposed therethrough;

ii. a barrel portion outer circumference;

iii. a barrel portion inner circumference opposite said outer circumference, said inner circumference defining a barrel interior portion; and iv. an end opposite said base, and v. a barrel length defined by a distance of the barrel from the base to the end;

(b) an outer jacket having:

i. a base;

ii. an outer circumference; and iii. an inner circumference, said outer jacket disposed adjacent said barrel portion such that the outer jacket inner circumference is adjacent the barrel portion outer circumference;

(c) a primer disposed within said primer aperture;

(d) propellant disposed within the interior portion of the barrel portion adjacent said base and said primer;

(e) a shot wad disposed within the interior portion of the barrel portion adjacent the propellant; and (f) a wad disposed within the interior portion of the barrel portion adjacent the shot wad, said wad being disposed in the barrel interior portion at a distance of about $1/3^{rd}$ the barrel length from the end of the barrel.

10. The buckshot round of claim 9, wherein the outer jacket is a thermoplastic.

11. The buckshot round of claim 9, wherein the outer jacket is nylon.

12. The buckshot round of claim 9, wherein the barrel portion is formed of a metallic material.

13. The buckshot round of claim 9, wherein the outer jacket is a composite material.

14. The buckshot round of claim 9, wherein the outer jacket is formed around the barrel portion, so as to be integral therewith.

* * * * *